US005155868A

United States Patent [19]

McLean, Jr.

[11] Patent Number: 5,155,868

[45] Date of Patent: Oct. 20, 1992

[54] PERSPIRATION EVAPORATION ENHANCING CAP

[76] Inventor: Douglas B. McLean, Jr., 37 Esquire Ave., Centerville, Ohio 45459

[21] Appl. No.: 687,732

[22] Filed: Apr. 19, 1991

[51] Int. Cl.[5] ..... A42B 1/00

[52] U.S. Cl. ..... 2/173.5; 2/181.2; 2/195

[58] Field of Search ..... 2/171, 173.5, 175, 178, 2/179, 180, 181, 181.2, 182.1, 182.2, 184.5, 185 B, 185 C, 185 R, 195, 199, DIG. 1, DIG. 11

[56] References Cited

U.S. PATENT DOCUMENTS

| | | | |
|---|---|---|---|
| 553,043 | 1/1896 | Samuels | 2/173.5 |
| 1,350,535 | 8/1920 | Williams | 2/182.2 |
| 1,520,290 | 12/1924 | Franklin | 2/173.5 |
| 1,758,142 | 5/1930 | Brooker | 2/181.2 |
| 1,855,795 | 4/1932 | Dorsey | 2/173.5 |
| 1,894,213 | 1/1933 | Ostolaza | 2/182.1 |
| 1,932,004 | 10/1933 | Wittcoff | 2/173.5 |
| 2,214,995 | 9/1940 | Dorsey | 2/173.5 |
| 2,226,133 | 12/1940 | Lee | 2/179 |
| 2,286,202 | 6/1942 | Fischer | 2/173.5 |
| 2,779,947 | 2/1957 | Severy | 2/185 B |
| 4,970,729 | 11/1990 | Shimazaki | 2/181.2 |

FOREIGN PATENT DOCUMENTS

| | | | |
|---|---|---|---|
| 226469 | 12/1924 | United Kingdom | 2/185 C |

*Primary Examiner*—Werner H. Schroeder
*Assistant Examiner*—Diana L. Biefeld
*Attorney, Agent, or Firm*—G. J. Muckenthaler

[57] ABSTRACT

The head band of a cap has a resilient member positioned around the rear of the cap with end portions of the resilient member secured to a frontal head band portion in the vicinity of the temples of the wearer of the cap. The end portions of the resilient member urge the frontal head band portion of the cap away from the forehead of the wearer and the frontal head band portion is formed in convex manner relative to the forehead of the wearer of the cap to provide a venturi-like opening between the frontal head band portion and the forehead for enhancing evaporation of perspiration from the forehead of the wearer of the cap.

15 Claims, 2 Drawing Sheets

PERSPIRATION EVAPORATION ENHANCING CAP

BACKGROUND OF THE INVENTION

In the field of headgear such as hats and caps, the "baseball type" cap has commanded the vast majority of the market by all ages of the populace. The baseball cap has gone through certain variations in style and design with the original styles fitting closely on the head of the wearer. Other styles have included a raised top portion to enable a looser fitting cap with such top portion spaced from the head of the wearer and a more curved bill to provide added protection from the elements. Further styles of caps that are worn at sporting events include the "baseball" type cap that has a mesh portion covering the rear half or so of the crown of the cap in order to provide for better ventilation. Also, the caps that are worn for golf and/or tennis provide a front portion with a bill and a headband, but may lack a rear portion of the crown so as to allow movement of air to the head of the wearer.

It is well known that a cap must fit sufficiently tight so as not to be blown away in winds during the course of active participation in a sport. Another area of proper fit of a cap must be in boating so as to avoid losing the cap into the water. It is also well known that the cap normally includes a sweatband which fits fairly tight on the head of the wearer and that the average person perspires profusely at the forehead. A very common sight shows athletes removing the cap and wiping the brow to remove perspiration many, many times during the course of a contest.

There have been many ways and means to obtain relief from perspiration in the wearing of previous hats and caps. However, many of these ways and means have been costly or are not convenient to manufacture or are very complex in nature.

Representative documentation in the field or area of ventilating hats or caps includes U.S. Pat. No. 215,998, issued to V. B. Waddell et al. on May 27, 1879, which discloses a ventilating hat with three angular rests that curve inwardly and fit on the head of the wearer.

U.S. Pat. No. 553,043, issued to F. W. Samuels on Jan. 14, 1896, discloses a cap with a wire frame and a cross bar forming an open space between the forehead of the wearer and the front portion of the cap.

U.S. Pat. No. 1,133,934, issued to G. M. Collins on Mar. 30, 1915, discloses a sweat band with felt pads that provide a space between front and rear sections for ventilation.

U.S. Pat. No. 1,266,661, issued to T. L. Burns on May 21, 1918, discloses a pressure relieving and ventilating attachment for hats that comprises front and rear pads for ventilation.

U.S. Pat. No. 1,350,535, issued to C. R. Williams on Aug. 24, 1920, discloses a hat ventilator that spaces the front of the hat from the forehead of the wearer by spring arms inside the sweat band.

U.S. Pat. No. 1,758,142, issued to W. H. Brooker on May 13, 1930, discloses a hat ventilator with a strip of metal formed with an offset portion to allow passage of air between the wearers head and the offset portion.

U.S. Pat. No. 1,765,723, issued to J. C. Gustaveson on Jun. 24, 1930, discloses a hat with a lazy-tongs formed head band to allow circulation of air.

U.S. Pat. No. 2,629,873, issued to L. Jarosenski on Mar. 3, 1953, discloses a hat attachment in the form of a resilient band with arcuate front and rear portions spaced from the wearers head for ventilation.

U.S. Pat. No. 2,818,574, issued to G. C. Burnison on Jan. 7, 1958, discloses a ventilation attachment that comprises a sweat band with inwardly protruding grommets.

U.S. Pat. No. 2,832,077, issued to W. H. McGinnis on Apr. 29, 1958, discloses a head cooler comprising a liquid absorbing pad.

And, U.S. Pat. No. 4,951,320, issued to C. S. Yoon on Aug. 28, 1990, discloses an inner rim of a cap with projecting members that form a plurality of ventilating apertures.

SUMMARY OF THE INVENTION

The present invention relates to ventilating means for hats or caps. More particularly, the present invention is directed to a formed band which is a part of a hat or cap that causes the sweat band of the cap to move away from the forehead of the wearer of the cap. The formed band occupies the rear part of the sweat band and urges the front part of the sweat band away from the forehead. The formed band is resilient and has end portions that contact and attach to the sweat band of the cap at the temples of the wearer to urge the sweat band away from the forehead and thus provide for evaporation of perspiration on the brow of the wearer of the cap. The front part of the sweat band is formed in a curved or convex manner relative to the forehead of the wearer of the cap to provide a venturi-like opening between the sweat band and the forehead. In this regard, the front portion of the sweat band is spaced a small distance from the forehead and is formed to create a venturi-like effect that enhances the evaporation process.

In view of the above discussion, a principal object of the present invention is to provide a cap that enhances evaporation of perspiration from the brow of the wearer of the cap.

Another object of the present invention is to provide a cap having a sweat band on the front of the cap that is spaced from the forehead of the wearer for ventilation purposes.

An additional object of the present invention is to provide a method for enhancing the evaporation of perspiration from the brow of the wearer of a cap or hat.

A further object of the present invention is to provide a formed band as a part of the sweat band of a cap that is resilient and urges the sides of the sweat band against the temples of the wearer of the cap and thereby provides a space between the front part of the sweat band and the forehead of the wearer for ventilation and for enhancing the evaporation of perspiration from the forehead.

Additional advantages and features of the present invention will become apparent and fully understood from a reading of the following description taken together with the annexed drawing.

DESCRIPTION OF THE PREFERRED EMBODIMENT

Figure 1:
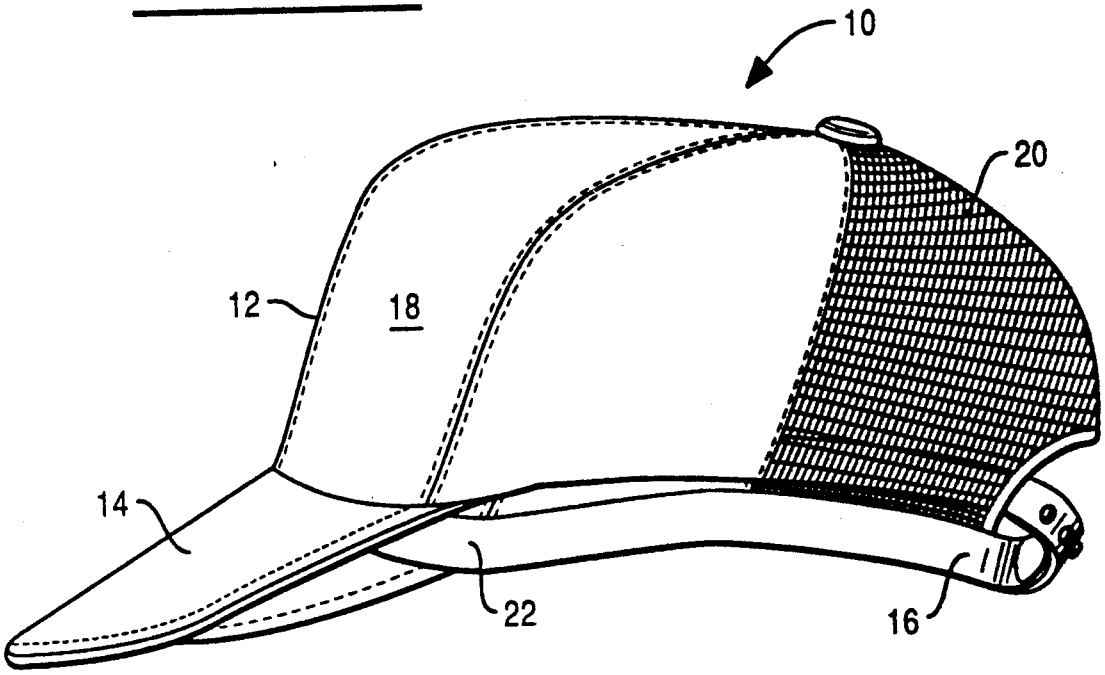
FIG. 1 PRIOR ART
FIG. 1 is a diagrammatic view of a traditional "baseball type" cap having an adjustable head band at the rear thereof.

Referring now to the drawing, FIG. 1 is a diagrammatic view of a "baseball type" cap 10 of well-known design. The cap 10 includes a crown 12, a bill 14, and an adjustable head band 16 that fits snugly against the head of the wearer of the cap. It is, of course, known that this type cap is also worn by golfers, tennis players, and yachtsmen, as well as by members of the general public. The crown 12 of the cap 10 may be completely closed with cloth-like material or it may have cloth material 18 on the front of the crown and have mesh-like material 20 on the rear of the crown of the cap for ventilation.

There are many variations of the design and style of this type cap 10, one of which has an open rear portion of the crown 12. The adjustable head band 16 may be a part of and attached to a front portion 22 of the head band. The adjustable band or portion 16 of the head band is provided to allow for a correct fit of the cap 10 and thus satisfy a degree of tightness or looseness of the head band with the head of the wearer of the cap.

Figure 2:
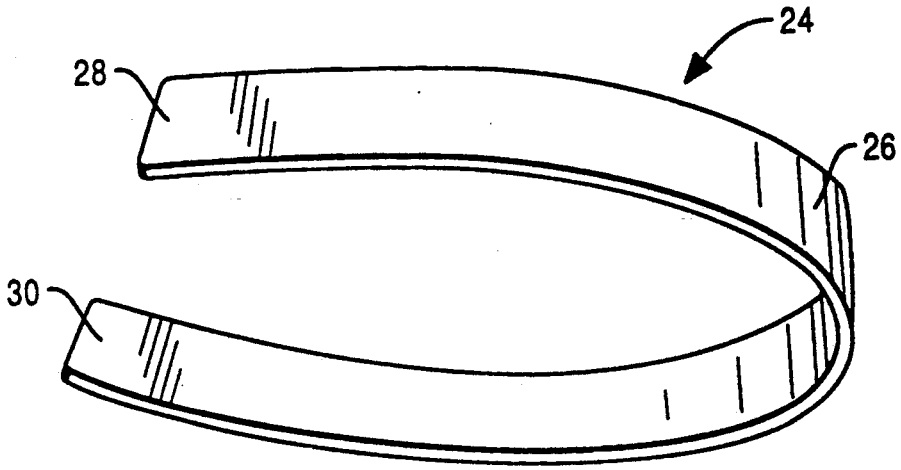
FIG. 2 is a perspective view of a U-shaped resilient band that is incorporated in the structure of the cap of the present invention.

It has been found that a new concept in cap design provides for a preformed member, as 24 in FIG. 2, to occupy the rear portion of the head band of a cap. The member 24 is made of plastic or metallic spring-like material which has a certain amount of resilience and is formed in a U-shape with a rear curved portion 26 and forwardly projecting end portions 28 and 30. This U-shaped member 24 is similar to the bands which are worn by many women over the top of the head to keep the hair in place and to prevent the hair from flying in the wind or from obstructing the view. The end portions 28 and 30 are formed in a slightly inwardly manner to provide a secure fit on the head of the wearer of the cap.

Figure 3:
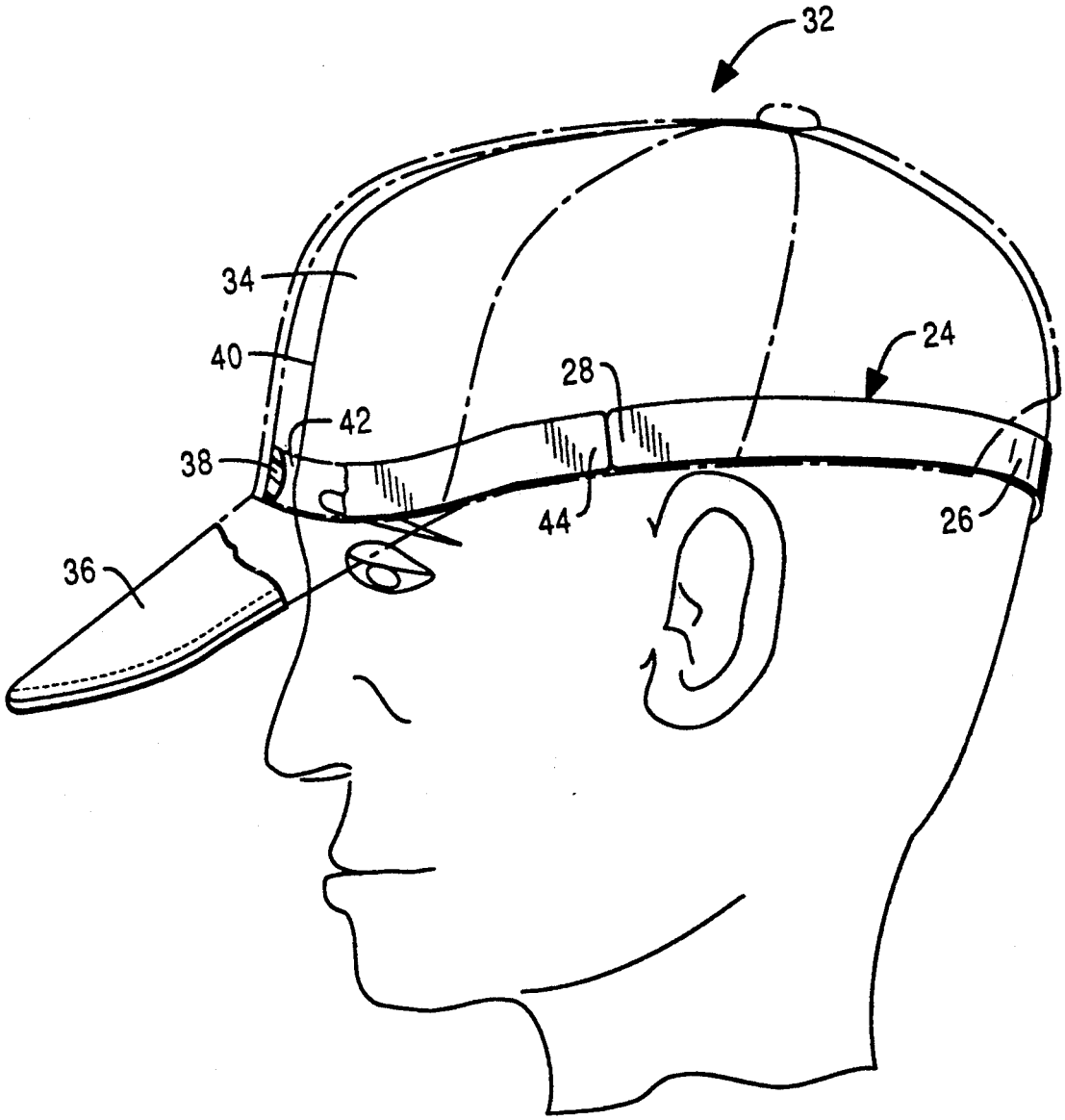
FIG. 3 is a view of a "baseball type" cap with the U-shaped band and illustrating the opening between the sweat band and the forehead of the wearer of the cap.

FIG. 3 illustrates a cap 32 which incorporates the U-shaped band 24 of the present invention as a part thereof. The cap 32 has a crown 34, a bill 36, and a frontal head or sweat band 38. The crown 34 may be of cloth or of mesh material, or the rear of the crown of the cap 32 may be open. The head band 38 is attached to the crown 34 and the bill 36 is attached to the head band. The U-shaped band 24 is attached to the frontal head band 38 in the vicinity of the temples of the wearer of the cap 32. The end portions 28 and 30 of the U-shaped band 24 urge side portions, as 44, (only the left side portion 44 being shown in FIG. 3) of the frontal band 38 of the cap 32 against the temples of the head of the cap wearer. This urging by the end portions 28 and 30 against the side portions 44 causes the frontal band 38 to move away from the forehead 40 of the wearer of the cap 32, thereby providing a space between the forehead 40 and the frontal band 38.

The frontal band 38 is formed or curved in convex manner relative to the forehead 40 of the wearer of the cap 32. The convex shape of the frontal band 38 relative to the forehead 40 provides a venturi-like or shaped opening 42 so as to enhance movement of air past the forehead or brow of the wearer of the cap 32. In this regard, the effect is that any movement of air or wind, however slight, will cause evaporation of any perspiration on the forehead 40 and thus cool the forehead. It is also seen that any slight movement of air through the opening 42 will tend to minimize the tendency to perspire in the area of the forehead or brow 40.

The U-shaped member 24 of the present invention replaces the adjustable head band or head band portion 16 of the cap 10 in FIG. 1. The U-shaped member 24 (FIG. 2) holds the cap 32 (FIG. 3) securely on the head of the wearer by reason of urging the frontal band 38 against the head in the vicinity of the temples of the wearer of the cap 32 by pressing of the end portions 28 and 30 against the side portions 44. The spring effect or resilience of the U-shaped member 24 provides for such urging to maintain the cap 32 in position on the head of the wearer while the frontal band 38 is moved a small distance from the forehead 40 to allow air to flow through the venturi-like opening 42 and thus enhance evaporation of perspiration.

It is also noted that the member 24 occupies a majority of the head band of the cap 32 and is made to correctly fit the rear portion of the head of the wearer of the cap. Additionally, it is noted that the spring-like metal or plastic material of the member 24 is covered with suitable cloth or leather-like material useful in the manufacture of sweat bands or head bands for caps.

It is thus seen that herein shown and described is a cap having a resilient head band member that is formed to hold the cap securely on the head of the wearer of the cap and to provide a space or opening between the frontal head band and the forehead to enhance evaporation of perspiration from the forehead. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

What is claimed is:

1. A method of enhancing evaporation of perspiration from the forehead of the wearer of a cap comprising the steps of:

providing a cap having a front head band portion, providing a resilient member around the rear of the cap and forming a rear portion of the head band of the cap, said resilient member having end portions located in the vicinity of the temples of the wearer of the cap, and fastening said end portions of the rear head band portion of the cap to the front head band portion of the cap, said end portions urging the front head band portion against the head of the wearer of the cap in the vicinity of the temples so as to move the front head band portion of the cap away from the forehead of the wearer of the cap, said front head band portion being curved outwardly at the top and bottom edges thereof relative to the forehead of the wearer of the cap to provide a curved opening between the front head band portion and the forehead for enhanced passage of air through said opening.

2. The method of claim 1 wherein the front portion of the head band is curved in convex manner relative to the forehead of the wearer of the cap.

3. The method of claim 1 wherein said resilient member is generally U-shaped and occupies the majority portion of the head band of said cap.

4. The method of claim 1 wherein said resilient member is made of non-metallic material.

5. The method of claim 1 wherein said resilient member is made of metallic spring material.

6. A cap having a head band portion at the front thereof, and a head band portion at the rear thereof, said rear head band portion comprising a resilient member having end portions located in the vicinity of the temples of the wearer of the cap, said end portions being secured to the front head band portion and urging said front head band portion against the head of the wearer of the cap in the vicinity of the temples so as to move the front head band portion away from the forehead of the wearer of the cap for enhancing evaporation of perspiration from the forehead of the wearer of the cap, said front head band portion having top and bottom edges and said edges being curved outwardly in a generally horizontal direction relative to the forehead of the wearer of the cap to provide a curved opening between the front head band portion and the forehead for enhanced passage of air through said opening.

7. The cap of claim 6 wherein the front head band portion is curved in convex shape relative to the forehead of the wearer of the cap.

8. The cap of claim 7 wherein the convex shape of the front head band portion is formed with respect to the forehead of the wearer of the cap to create a venturi-like opening for movement of air in enhancing evaporation of perspiration from the forehead of the wearer of the cap.

9. The cap of claim 6 wherein said resilient member is generally U-shaped and occupies the majority portion of the head band of said cap.

10. The cap of claim 6 wherein said resilient member is made of plastic material.

11. The cap of claim 6 wherein said resilient member is made of metallic material.

12. The cap of claim 6 wherein said resilient member is generally U-shaped and said end portions are formed inwardly at the temples of the wearer of the cap for holding the cap securely on the head of the wearer of the cap.

13. The cap of claim 6 wherein the resilient member is made of a solid, single piece of material.

14. In a cap having a crown portion, a frontal head band portion secured to the crown portion, and a bill secured to the head band portion at the front of the cap, the improvement comprising a head band portion positioned around the rear of the cap and secured to the frontal head band portion in the vicinity of the temples of the wearer of the cap, said rear head band portion comprising a resilient member having end portions urging the frontal head band portion against the head of the wearer of the cap in the vicinity of the temples so as to move the frontal head band portion away from the forehead of the wearer of the cap for enhancing evaporation of perspiration from the forehead of the wearer of the cap, providing a resilient member around the rear of the cap and forming a rear portion of the head band of the cap, said resilient member having end portions located in the vicinity of the temples of the wearer of the cap, and fastening said end portions of the rear head band portion of the cap to the front head band portion of the cap, said end portions urging the front head band portion against the head of the wearer of the cap in the vicinity of the temples so as to move the front head band portion of the cap away from the forehead of the wearer of the cap, said front head band portion being curved outwardly at the top and bottom edges thereof relative to the forehead of the wearer of the cap to provide a curved opening between the front head band portion and the forehead for enhanced passage of air through said opening.

15. In the cap of claim 14 wherein the frontal head band portion is convex shaped relative to the forehead of the wearer of the cap and said resilient member urges the frontal head band portion away from the forehead of the wearer of the cap to create a venturi-like opening between the frontal head band portion of the cap and the forehead of the wearer of the cap.

* * * * *